United States Patent [19]

Winston

[11] Patent Number: 4,847,916

[45] Date of Patent: Jul. 18, 1989

[54] CHILD'S DECORATIVE GARMENT

[76] Inventor: Gary A. Winston, 1132 Church St., Benicia, Calif. 94510

[21] Appl. No.: 631,404

[22] Filed: Jul. 16, 1984

[51] Int. Cl.[4] ..... A41B 1/18; A41D 27/08; G09F 21/02

[52] U.S. Cl. ..... 2/113; 2/115; 40/586

[58] Field of Search ..... 2/113, 48, 115; 40/586; 434/395, 396, 238, 236, 260

[56] References Cited

U.S. PATENT DOCUMENTS

| | | | |
|---|---|---|---|
| D. 155,036 | 8/1949 | Rielly | 2/115 |
| D. 247,536 | 3/1978 | Nally | 2/115 |
| 3,906,642 | 9/1975 | Cohen | 434/260 |
| 4,037,272 | 7/1977 | Shani | 2/48 |
| 4,354,282 | 10/1982 | Langdon | 2/115 |

OTHER PUBLICATIONS

Earnshaw's Infants Girls Boys Wear Review, vol. 65, No. 7, Jul. 1981, p. 5.

*Primary Examiner*—Werner H. Schroeder
*Attorney, Agent, or Firm*—John R. Murtha

[57] ABSTRACT

A garment for human beings to cover at least the upper torso. On the garment is a decorative design having a specific cognitive orientation and is positioned such that the wearer readily recognizes the design. The design is further incorporated into an additional design having a specific cognitive orientation which is readily recognizable by a nonwearing observer.

1 Claim, 1 Drawing Sheet

CHILD'S DECORATIVE GARMENT

The invention relates to decorative design elements for garments to be worn by human beings and, more particularly, to decorative design elements for garments to be worn by children.

Recent research has discovered that babies and very young children are responsive to interesting visual stimuli. It is now believed that presenting interesting decorative design elements to babies and very young children enhances their adaptation to the world and improves their mental abilities. Mothers are encouraged to present visual stimuli to their babies by, among other things, the use of interesting hanging mobiles above the crib and by papering the walls of the youngster's nursery with wallpaper having interesting figures and designs thereon.

The present invention has for its object the provision of another means of presenting interesting decorative design elements to youngsters not previously utilized for this purpose.

Figure 1:
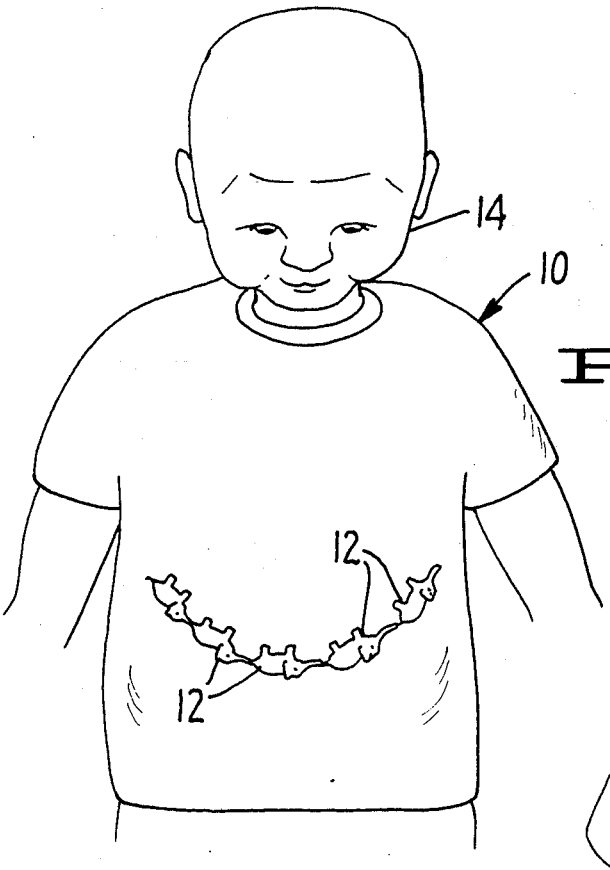
Figure 2:
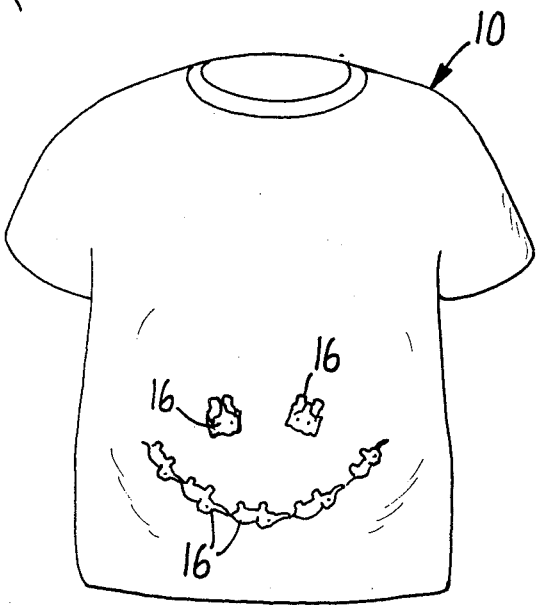

A preferred embodiment is shown in the accompanying drawings in which:

FIG. 1 is a front view of a youngster wearing a garment having decorative design elements made and positioned in accord with the teachings of the invention, and FIG. 2 is a front view of a garment made in accord with the teachings of the invention in which the decorative design elements are arranged in an alternative way.

As is shown in FIG. 1, the invention comprises a garment 10,10 intended to be worn by human beings having decorative design elements 12,12 possessing a specific cognitive orientation. The decorative design elements 12,12 are positioned on the garment so that the specific cognitive orientation is presented to the wearer 14 of the garment 10.

The phrase "decorative design elements having a specific cognitive orientation" is intended to mean decorative design elements, not including reading matter, that are intended to be viewed from a particular perspective or viewpoint. It is intended to distinguish decorative design elements of the type that present the same image without regard to any particular orientation or viewpoint. An example of the latter would be design elements of a geometrical character that can be viewed with the same result from more than one particular orientation or viewpoint.

An example of decorative design elements having a specific cognitive orientation can be seen in FIG. 1. The design elements on the garment shown in this drawing comprise a series of elephants 12,12. To be recognized as such requires that the animals be shown "right side" up. In accord with the teachings of the invention the design elements 12,12 are positioned and located on the garment 10 in such a way that the animals look "right side" up to the wearer and not to a nonwearing observer, that is, the specific cognitive orientation of the design elements is presented to the wearer of the garment.

Alternatively, the decorative design elements may have a secondary, or additional, cognitive orientation. An example of such a situation is shown in FIG. 2. This drawing shows a series of elephants 16,16 that are positioned with a specific cognitive orientation that is presented to the wearer, i.e., the animals are shown "right side" up when seen from the wearer's perspective. The animals are also arranged to form a design motif that has a secondary, or additional, cognitive orientation. In this case the elephants 16,16 are also arranged in such a manner that a nonwearer observer sees the popular design of a "happy face."

The invention is not limited to any particular age group in its application, but its greatest utility is on garments for young children from birth to about eight years. It may be applied to all types of garments, including without limitation, bibs, T-shirts, undershirts, blouses and shirts, dresses, sweaters, and pajamas. The design elements, in their cognitive orientation, should make up something known to the wearer either as an object or an action (i.e. a smile). The design elements must be located on the garment where they can be seen by the wearer. Preferably this will be on the portion of the garment covering the upper torso of the wearer, although the design elements may also be placed on the sleeves of the garment especially if the garment has long sleeves. It is preferred that the decorative design elements be positioned on the portion of the garment fitting over the wearer's stomach, or abdominal, area.

I claim:

1. A garment for human beings made to cover at least the upper torso of a person and having one or more decorative design elements possessing a specific cognitive orientation, said decorative design elements being positioned on the garment so that the specific cognitive orientation of the design elements is presented to the wearer and said same decorative design elements are cooperatively arranged on the garment to form an additional design having a specific cognitive orientation that is positioned on the garment to be presented to a nonwearing observer.

* * * * *